US005240395A

United States Patent [19]

O'Conner et al.

[11] Patent Number: 5,240,395

[45] Date of Patent: Aug. 31, 1993

[54] MOLD STRIPPING EQUIPMENT FOR MANUFACTURE OF PRESTRESSED CONCRETE POLES

[75] Inventors: James F. O'Conner, Grass Valley; William A. Muller, Fillmore, both of Calif.

[73] Assignee: Ameron, Inc., Pasadena, Calif.

[21] Appl. No.: 710,094

[22] Filed: Jun. 4, 1991

[51] Int. Cl.[5] ..... B28B 7/10; B28B 21/60

[52] U.S. Cl. ..... 425/111; 249/66.1; 264/229; 425/436 R

[58] Field of Search ..... 264/228, 229, 288.4, 264/288.6; 249/48, 66.1; 425/111, 127, 436 R, 436 RM, 438, DIG. 53, 595, 440

[56] References Cited

U.S. PATENT DOCUMENTS

| | | | |
|---|---|---|---|
| 3,478,396 | 11/1969 | Drouillard | 425/111 |
| 3,993,419 | 11/1976 | Mori et al. | 264/229 |
| 4,571,169 | 2/1986 | Shima et al. | 425/589 |

FOREIGN PATENT DOCUMENTS

| | | | |
|---|---|---|---|
| 987476 | 4/1976 | Canada | 425/111 |
| 2600587 | 12/1987 | France | 264/229 |
| 1-291904 | 11/1989 | Japan | 264/229 |
| 1323685 | 7/1987 | U.S.S.R. | 264/229 |

*Primary Examiner*—Khanh P. Nguyen

*Attorney, Agent, or Firm*—Christie, Parker & Hale

[57] ABSTRACT

A stripping station which is used for stripping a mold from a cast concrete lamp pole has a mold that has an axial compressive load placed thereon by a tension force applied to tension members running through the mold. The tension members are secured to anchors located at one end of the mold. A stripping fixture attached to the anchors exerts a tension force sufficient to relieve the axial compressive load on the mold and transfers the axial load to the frame of the stripping machine. This allows the mold to be removed. The axial compression load is transferred to the pole after the mold is stripped.

15 Claims, 2 Drawing Sheets

MOLD STRIPPING EQUIPMENT FOR MANUFACTURE OF PRESTRESSED CONCRETE POLES

FIELD OF THE INVENTION

This invention relates generally to equipment used in the manufacture of lamp poles and more particularly to a stripping station for stripping the mold from a cast prestressed concrete lamp pole comprising a hydraulic cylinder located at one end of the stripping station used to transfer the prestress axial load from the pole mold to the cylinder so that the mold can be removed from the pole.

BACKGROUND OF THE INVENTION

It is known that the manufacture of prestressed concrete poles involves the casting and hardening of concrete in molds with special requirements for the operations of positioning, stressing and loosening the mold. To date, there have been many commercial articles made from prestressed concrete materials. These articles include tubular pipes, beams, support columns, and poles, which may be reinforced by steel strands embedded in the concrete or by rods, bars, and/or tubes for reinforcement located in the concrete. A large number of prestressed concrete articles have been manufactured and it is always desirable to provide means which makes manufacturing of these articles less expensive as well as easier to accomplish.

Prestressed concrete lamp poles are cast in a mold. The empty mold is assembled with a number of separate pieces bolted together, and in order to prestress a concrete pole, an axial compressive load is placed on the mold. The axial load is transmitted through the mold by prestressing strands which extend through the mold and are attached at either end of the mold. After prestressing the strands in tension, the mold is pumped full of concrete and rotated to centrifugally consolidate the concrete. Once the mold is full, it is generally conveyed through a heated chamber to accelerate the curing of the concrete. The prestressing load is then ready to be transferred from the mold to the pole and the mold can be removed from the finished product.

Typical molds used to cast concrete poles are solid steel molds. Depending upon the intricacy or the ornamentality of the pole to be cast, the mold is composed of separate segments corresponding to each distinct pattern located on the pole. Solid steel molds are composed of two or more pieces in which the pattern to be cast is machined into the interior surface of the mold pieces such that when the mold pieces are joined together a hollow cavity exists corresponding to the pattern of the pole.

A number of patterns can be incorporated into a single pole, however, it is also common for a single pattern to dominate a pole structure. A very popular pattern for a concrete lamp pole is a fluted pattern. Generally, a fluted pattern dominates the overall pattern of a lamp pole. Sometimes in a fluted pole very ornate patterns are located at the base and top ends of the pole which include circumferentially extending extensions and depressions from the general surface of the pole.

Many concrete pole molds are made of segments to be interchangeable so that the designs of the poles can be varied by changing one or more of the segments without having to reconstruct the entire mold. Pole molds are also constructed in circumferential sectors, for example, three 120 degree sectors, which makes it easier for the mold to be stripped from a cast pole. The particulars of this type of mold can be understood from applicant's patent application Ser. No. 07/683,303, filed Apr. 10, 1991 now U.S. Pat. No. 5,178,887, and incorporated by reference as if fully set forth herein.

When a pole has been cast and the prestressing load transferred from the mold to the pole, it has been experienced that the length of the standard, smooth surface, straight tapered pole, shortens as much as one-half of an inch, depending upon the pole length, before the pole has fully cured. With this type of pole, the shortening causes no damage and presents no problem, however, it has been experienced that with ornate poles, with undercut areas, when the prestressing load is transferred to the pole while still in the mold, the decorative configurations are severely damaged by pole shrinkage. The mold elongates as compressive stress is relieved and the concrete pole shortens as the prestressing load is applied. The differential motion can cause the pole to stick in the mold and shear off raised decorative elements.

Thus, there exists a need for mold stripping equipment which allows the mold to be removed before the prestressed tension is applied to the pole and thereby eliminate any damage due to shrinkage.

SUMMARY OF THE INVENTION

The present invention provides a stripping station designed to maintain a decorative prestressed concrete pole in equilibrium while the pole mold is removed. Subsequently, when the prestressing force is transferred to the pole, the decorative designs will not be damaged due to the pole still being in the mold when the shrinkage occurs. The stripping station has been designed and put into service whereby the prestress load is transferred from the mold to the station during mold removal.

The base of the mold is anchored to the headstock end of the stripping station and the top end of the mold is anchored to the tailstock end of the stripping station. Tension is applied by a hydraulic cylinder, also located at the tailstock end of the station, to the prestressed strands. The tension is roughly equal to the original prestressing load, which results in the pole being held in a state of equilibrium. While the pole is in equilibrium, the mold segments can be removed. The prestressing load can then be transferred from the hydraulic cylinder gradually to the pole without damage. Any shrinkage that then occurs will be outside of the mold and will not affect the decorative patterns.

These and other aspects of the invention will be more fully understood by referring to the detailed description and the accompanying drawings.

DETAILED DESCRIPTION

Figure 1:
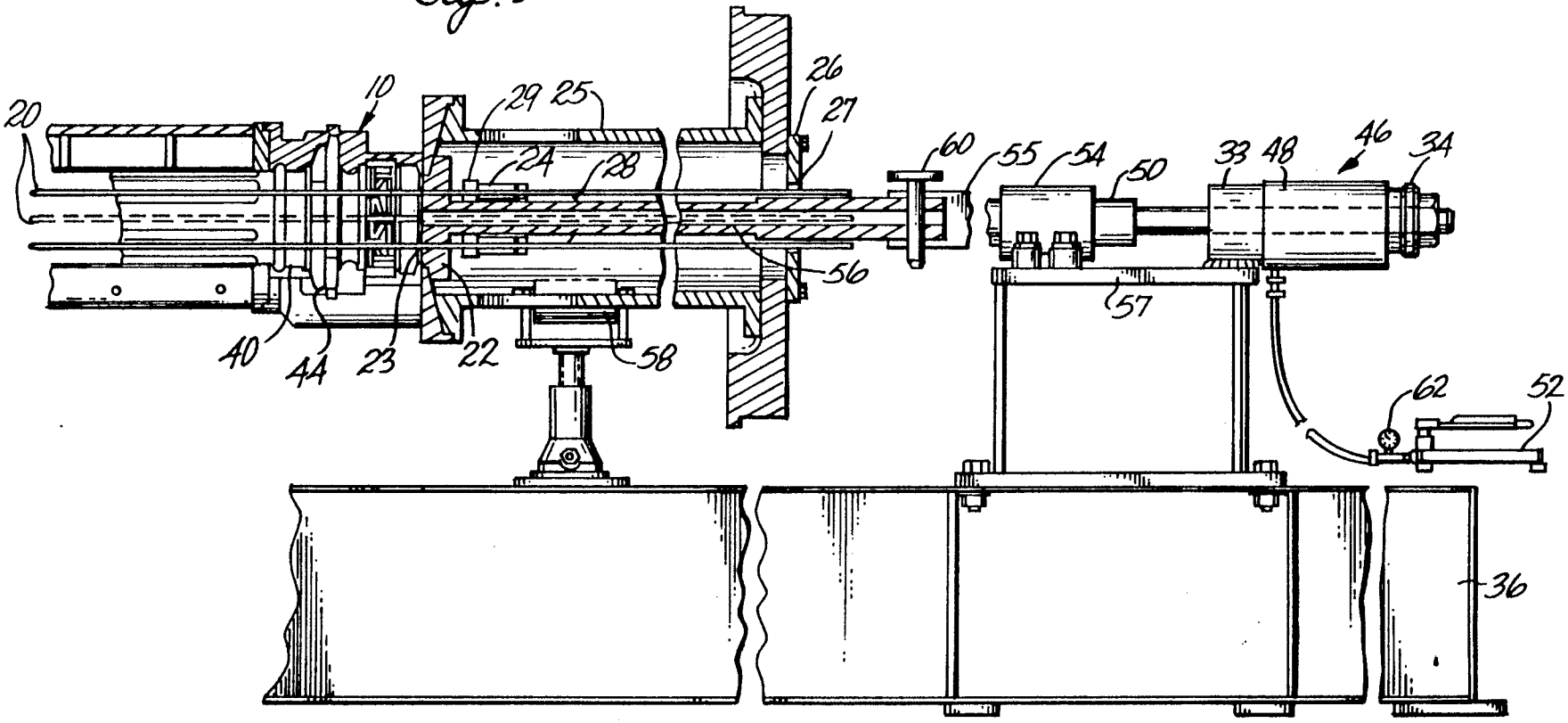
FIG. 1 is a longitudinal cross-sectional view of the tailstock portion of the stripping station.
Figure 2:
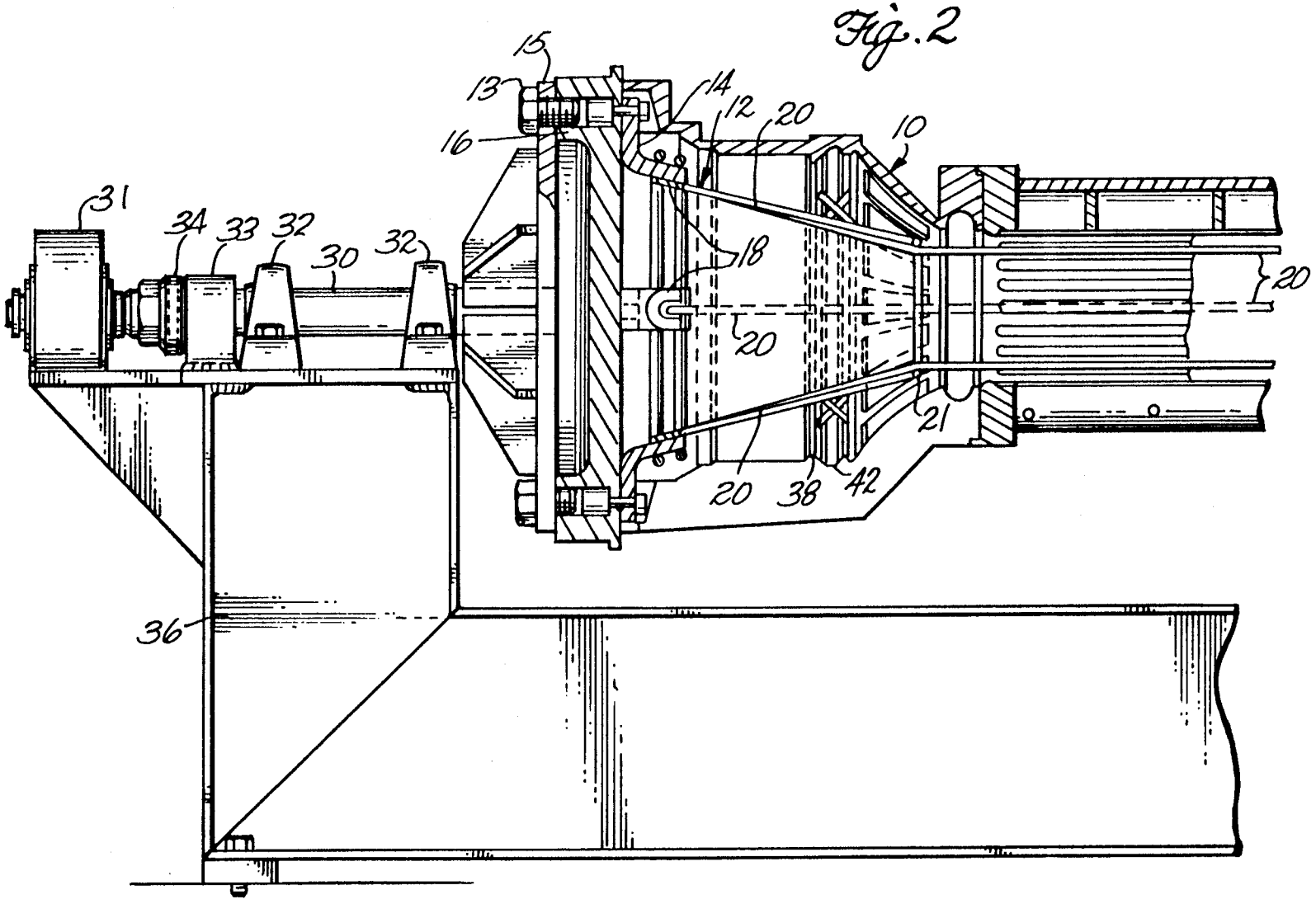
FIG. 2 is a longitudinal cross-sectional view of the headstock portion of the stripping station of FIG. 1.

FIGS. 1 and 2 illustrate the headstock and tailstock portions of a prestressed concrete pole stripping station constructed in accordance with principles of this invention. To manufacture an ornate prestressed concrete pole, an empty mold 10 must be assembled to withstand the axial compressive load placed on the mold. Many concrete poles that are prestressed are heavily steel reinforced. The steel reinforcement for the pole comprises steel reinforcing bars welded into a base cage 12 which is generally conical in shape and located in the base portion of the pole. The base cage has four L-shaped anchor lugs 14 which extend radially beyond the surface perimeter of the pole base. The anchor lugs are used to bolt the cage to a base end mold runner ring 16 while the pole is being cast. Once the pole has been cast the anchor lugs serve to secure the pole to a ground foundation.

Prestressing strand anchors 18 which serve as an attachment point for prestressing strands 20 are located on the opposite end of the anchor lugs from the bolt holes. The prestressing strands have an end connected to the anchors, extend along the inside of the cage and turn to an axial direction inside a ring 21 at the upper end of the cage. The prestressing strands extend the entire length of the pole and pass through a prestressing head 22 located at the top end of the pole mold. The prestressing strands pass through holes 23 located in the prestressing head and then through anchor chucks 24 located in a mold extension tube 25. The tube 25 is used as a spacer only when poles less than fifteen feet long are cast. Poles longer than fifteen feet do not require a spacer. When used tube 25 is supported by an adjustable roller mechanism 58. The strands continue through the tube and out of a top end closure plate 26 through holes 27 in the plate. Once outside of the plate, the strands are attached to a prestressing machine (not shown) which exerts a tension force on the strands. The strands comprise seven wire high tensile steel cables which can withstand a large amount of prestress tension, up to approximately 250,000 psi. Each strand is stressed to approximately 7000 to 8000 pounds.

Once the desired force is exerted on the strands, an operator can reach inside the extension tube through a window 28 and secure the anchor chucks to the strands. There are four windows spaced ninety degrees apart located around the perimeter of the extension tube. The anchor chucks are collet-type chucks which when secured to the strands collapse on the strands and secure the strands against a plate 29. The plate 29 is located a slight axial distance from the prestress head 22, for example, about an inch. The prestress force can then be relieved from the prestress machine and the strands can be released from the machine. Now that the prestressing force is placed on the strands, a resulting compressive axial load is exerted on the mold. The strands are then snipped off at the surface of the end plate 26 so that when the mold is rotated no dangling ends are present which could cause injury.

After the pole has been cast, the mold can be stripped from the pole. As previously mentioned, when the prestress force is transferred from the mold to the pole, the pole will shorten and the mold elongates as the axial load is released, thereby causing, as an example, undercut portions 38 and 40 of the mold to shear off raised portions 42 and 44 of the pole. Therefore, the mold must be stripped from the pole before the prestress load is transferred from the mold to the pole.

Because this problem exists, a special stripping station is necessary to accommodate this type of pole design. The mold is transferred from the casting line to the stripping station by placing a sling around the mold and lifting the mold by a bridge crane and then lowering the mold into the U-shaped frame 36 of the stripping station. Bolts 13, of which there are six, are inserted through a peripheral hole pattern in the headstock faceplate 15 and threaded into a matching pattern of tapped holes in the outer face of the base end mold runner ring to secure the base end of the mold to the headstock portion of the stripping station.

Located at the tailstock portion of the stripping station is the stripping fixture 46. The stripping fixture comprises a hydraulic tensioning cylinder 48, a tensioning shaft 50 located within the tensioning cylinder, and a two-speed manual pump 52. The end of the tensioning shaft 55 opposite the cylinder is hollow for receiving the end of a prestress head extension shaft 56. The tensioning shaft moves axially through a sleeve bearing 54.

The prestress head extension shaft is a hollow shaft that is welded to the prestress head and extends axially through the top end closure plate. The end of the extension shaft opposite from the prestress head has an enlarged diameter that fits in the end of the tensioning shaft of the stripping fixture. The enlarged diameter of the extension shaft fits through a slightly larger diameter hole in the top end closure plate. Both the extension shaft and the tensioning shaft have holes therein so that they can be pinned together by pin 60.

The tailstock portion of the frame 57 is movable to compensate for cast poles which are from fifteen to twenty-one feet long.

To accomplish the mold stripping process, the prestress load is temporarily transferred from the mold to a stripping fixture. To transfer the prestressing load from the mold to the stripping fixture the pump is, engaged, which activates the hydraulic tensioning cylinder. The cylinder draws back the tensioning shaft which in turn exerts a tension force on the extension shaft. The prestress head then moves the anchor chucks a sufficient distance to overcome the prestressing load on the mold. The necessary amount of force that needs to be exerted by the hydraulic cylinder is arrived at empirically through a series of test runs for each pole design. When the proper force is determined, a reading can be taken from a pressure gauge 62 and recorded for subsequent use. Generally, the force exerted by the hydraulic cylinder is at least equal to the original prestressing load placed on the mold. This amount of force is sufficient to overcome the prestressing load without pulling apart the pole.

Once the prestressing load is transferred to the stripping fixture the mold is placed in a state of equilibrium, which allows the mold to be disassembled and removed from the pole piece by piece. Considering the mold comprises many segments each comprised of circumferential sectors, a drive assembly is located at the headstock portion of the frame to rotate the mold so that each sector is in the twelve o'clock position when removed. The drive assembly comprises a headstock shaft 30 welded to the headstock faceplate which extends axially to an air motor and gear box 31 which rotates the shaft. The headstock shaft is supported by pillow blocks 32 and a thrust block 33 which are located between the headstock faceplate and the air motor. Thrust bearings 34 are located at either end of the stripping station to withstand the tension load but allow the mold to be rotated for stripping.

After the mold has been removed, the hydraulic cylinder can gradually transfer the prestressing load to the cast pole. Any final shrinkage that results will be outside of the mold and therefore will not cause any damage to the decorative design of the pole. Once the prestress load has been returned to the pole, the pole can be removed from the stripping station. The pole is once again supported by a sling connected to the bridge crane, the four anchor lug bolts are removed from the base cage, the prestress strands are cut at the space between the prestress head 22 and the plate 29 located next to the anchor chucks, the prestress head is shifted to clear the stub ends of the prestress strand ends, the pin is removed from the extension shaft, the six bolts are removed from the headstock faceplate, and the pole is lifted out of the stripping station. The mold is reassembled by reversing these steps for return to the casting station.

Although the present invention has been described and is illustrated with respect to a preferred embodiment thereof, it is to be understood that it is not to be so limited, since change and modifications may be made therein which are within the full intended scope of this invention as hereinafter claimed. For example, in the stripping device, a pneumatic cylinder could be substituted for the hydraulic cylinder, or the prestress strand anchor chucks could be located outside of the end closure plate with the stripping device exerting a force directly on the chucks to overcome the prestress load, or the stripping device could be located at the headstock portion of the molding apparatus.

What is claimed is:

1. An apparatus for stripping a mold from a cast prestressed concrete pole comprising:

a frame structure including a headstock portion rigidly secured to a tailstock portion;

a mold supported by the headstock portion and the tailstock portion;

tensile prestressing means extending through the mold between the headstock portion and the tailstock portion which places an axial compressive load on the mold; and transfer means for engaging the prestressing means and transferring the axial compressive load from the mold to the frame structure.

2. An apparatus as recited in claim 1 wherein the prestressing means comprise prestressing strands which place the axial load on the mold by having a tension force placed on the prestressing strands.

3. An apparatus as recited in claim 1 wherein the transfer means is supported by the tailstock portion of the frame.

4. An apparatus as recited in claim 1 wherein the transfer means comprises a hydraulic cylinder and a shaft located within the cylinder which transfers the axial load on the mold to the cylinder by exerting a tension force on the prestressing means sufficient to overcome the axial load.

5. An apparatus as recited in claim 2 wherein the transfer means relieves the axial load on the mold while simultaneously maintaining the tension force on the prestressing strands.

6. An apparatus as recited in claim 1 further comprising a prestress head adjacent one end of the mold through which the prestressing means extend, anchor chucks for securing the prestress means adjacent the prestress head, and a prestress head extension shaft secured to the prestress head.

7. An apparatus as recited in claim 6 wherein the transfer means transfers the axial load on the mold to the transfer means by pulling on the prestress head extension shaft.

8. An apparatus as recited in claim 6 comprising a tube surrounding the prestress head and the extension shaft.

9. An apparatus as recited in claim 8 comprising a window located in the tube for facilitating securing of the anchor chucks to the prestressing means.

10. An apparatus as recited in claim 8 comprising means for supporting the tube above the frame structure.

11. An apparatus for stripping a mold from a cast prestressed concrete pole comprising:

a frame structure including a headstock portion and a tailstock portion;

a mold supported by the headstock portion and the tailstock portion;

prestressing strands which place an axial load on the mold by having a tension force placed on the strands;

a prestress head located adjacent one end of the mold;

an extension shaft connected to and extending axially away from the prestress head;

anchor chucks for securing the prestress strands to the prestress head once the tension force has been applied to the strands;

a tube surrounding the prestress head and extension shaft containing a window for facilitating securing the anchor chucks to the prestress strands;

means for supporting the tube above the frame structure; and means for pulling the extension shaft for relieving the axial load from the mold.

12. An apparatus as recited in claim 11 wherein the pulling means comprises a hydraulic cylinder and a shaft located within the cylinder which relieves the axial load on the mold by exerting a tension force on the extension shaft.

13. An apparatus as recited in claim 12 wherein the cylinder shaft and the extension shaft are pinned together.

14. An apparatus as recited in claim 11 wherein the pulling means relieves the axial load on the mold while simultaneously maintaining the tension force on the prestressing strands.

15. An apparatus as recited in claim 11 wherein the pulling means is supported by the tailstock portion of the frame.

* * * * *